US012385704B2

(12) United States Patent
Dawson, Jr.

(10) Patent No.: US 12,385,704 B2
(45) Date of Patent: Aug. 12, 2025

(54) FIREARM RECOIL DEVICES, SYSTEMS, AND METHODS

(71) Applicant: David J. Dawson, Jr., Florence, TX (US)

(72) Inventor: David J. Dawson, Jr., Florence, TX (US)

( * ) Notice: Subject to any disclaimer, the term of this patent is extended or adjusted under 35 U.S.C. 154(b) by 0 days.

(21) Appl. No.: 18/776,150

(22) Filed: Jul. 17, 2024

(65) Prior Publication Data

US 2025/0027733 A1 Jan. 23, 2025

Related U.S. Application Data

(60) Provisional application No. 63/527,768, filed on Jul. 19, 2023.

(51) Int. Cl.
*F41A 3/86* (2006.01)

(52) U.S. Cl.
CPC ..... *F41A 3/86* (2013.01)

(58) Field of Classification Search
CPC ..... F41A 3/78; F41A 3/82; F41A 3/86; F41A 11/00
See application file for complete search history.

(56) References Cited

U.S. PATENT DOCUMENTS 3,756,121 A * 9/1973 Roy ..... F41A 25/22 89/196
4,201,113 A * 5/1980 Seecamp ..... F41A 3/86 89/163
4,344,352 A * 8/1982 Yates ..... F41A 25/22 89/198
4,522,107 A * 6/1985 Woodcock ..... F41A 3/86 89/196
4,754,689 A * 7/1988 Grehl ..... F41A 3/86 89/196
6,129,000 A * 10/2000 Schmid ..... F41A 5/02 89/187.01
6,430,862 B1 * 8/2002 Berlin ..... F41C 27/00 29/270
2010/0269394 A1 * 10/2010 Ketchum ..... F41A 11/00 42/108
2012/0125189 A1 * 5/2012 McLean, III ..... G06Q 10/08 42/106
2015/0192383 A1 * 7/2015 Shrode ..... F41A 9/71 42/7
2022/0196352 A1 * 6/2022 Mooney ..... F41A 25/12
2023/0175797 A1 * 6/2023 Dawson, Jr. ..... F41A 21/36 89/199
2025/0027733 A1 * 1/2025 Dawson, Jr. ..... F41A 3/86
2025/0109919 A1 * 4/2025 Salinas ..... F41A 3/80

* cited by examiner

*Primary Examiner* — Gabriel J. Klein
(74) *Attorney, Agent, or Firm* — Lauff Law PLLC

(57) ABSTRACT

A recoil system is deployed with a slide plug comprising a catch means along with a plug retainer comprising a catch means. The slide plug catch means and plug retainer catch means may be compatible to permit the slide plug catch means and the plug retainer catch means to interfit and hold the recoil system in a partially compressed configuration. A method comprising a step of interfitting a slide plug catch means with a plug retainer catch means to hold the recoil system in a partially compressed configuration is described.

13 Claims, 11 Drawing Sheets

FIREARM RECOIL DEVICES, SYSTEMS, AND METHODS

CROSS-REFERENCE TO RELATED APPLICATIONS

This application claims the benefit under 35 U.S.C. § 119 (e) of U.S. Provisional Patent Application Ser. No. 63/527,768 filed Jul. 19, 2023.

BACKGROUND

Some firearms, for example semiautomatic pistols, may be configured with reciprocating slides. In some of these configurations, rearward motion of the slide following a shot is damped by compression of a spring. Forward motion of the slide back into battery results when the spring resiles from that compression. During compression and resiling of the spring, in some configurations a guide rod constrains the spring into a generally linear orientation. In some configurations, the guide rod is disposed through an opening in a plug disposed proximal to the muzzle end of the slide. This disclosure describes and enables various systems, structures, and configurations for recoil springs, guide rods, and plugs, and various methods for assembly and disassembly of recoil springs, guide rods, and plugs with a slide and barrel.

SUMMARY

In various embodiments, a recoil system is deployed a with slide plug comprising a catch means along with a plug retainer comprising a catch means. The slide plug catch means and plug retainer catch means may be compatible to permit the slide plug catch means and the plug retainer catch means to interfit and hold the recoil system in a partially compressed configuration.

In various embodiments, a recoil system may be removed from an assembled configuration with a slide and barrel by a method comprising a step of interfitting a slide plug catch means with a plug retainer catch means to hold the recoil system in a partially compressed configuration.

DESCRIPTION

Figure 1:
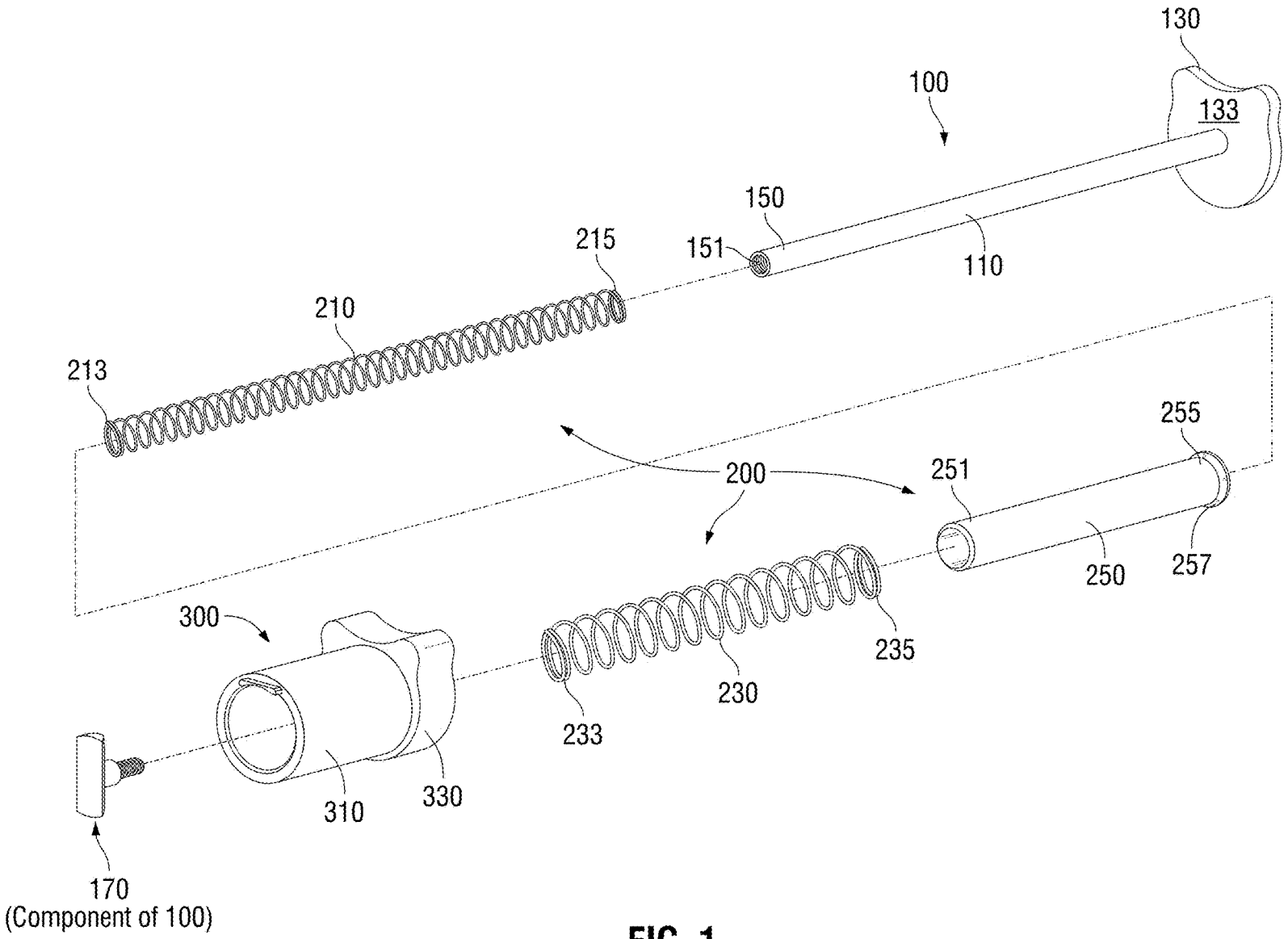
FIG. 1 is an exploded perspective view of a recoil system embodiment.

When used in this disclosure with respect to surfaces, edges, protrusions, recesses, or other geometries, unless clearly used differently the terms "compatible" and "complementary" mean that the items are configured to abut, fit together, or otherwise engage in a way that restrains relative translation or rotation, or both, in one or more directions, for example by having matching profiles mated together. As used in this disclosure, unless clearly used differently the term "interfitting parts" shall refer to plural structures having compatible or complementary surfaces, edges, protrusions, recesses, or other geometries, and those plural structures may be said to "interfit."

When used in this disclosure with respect or reference to a firearm or firearm components, unless clearly used differently the term "longitudinal" is used to refer to a direction substantially in alignment with the direction in which a projectile is ejected the firearm. In addition, when used in this disclosure with respect or reference to a firearm, unless clearly used differently the term "lateral" is used to refer to a direction that substantially deviates from the longitudinal direction, for example substantially orthogonal to the longitudinal direction. Unless clearly used differently, the terms "up," "upper," "top," "vertical," "down," "lower," "bottom" and "horizontal" are used with reference to a firearm when the firearm is oriented in the normal, most common position in which such device is operated by a person having ordinary or better skill using such device.

When used in this disclosure with respect to a structure or component, unless clearly used differently the correlative terms "attachable" and "detachable" indicate that such structure or component is capable of being attached or fastened to another structure or component, or correlatively detached or unfastened from another structure component, by use of fastening means such as screws, pins, detents, springs, pawls, clips, low-tack removable adhesives, compatible or complementary surfaces, and similar readily engageable and disengageable means, and the terms "attachment means," "fastening means," and "fasteners" shall be used in this disclosure to refer to any such items and any combination of such items. The terms "attaching" and "detaching" as used in this disclosure mean, respectively, attaching or fastening, and detaching or unfastening, structures or components that are "attachable" and "detachable." Structures and components that are integrally formed, or that are welded, bonded with high-tack permanent adhesives (such as cyanoacrylates and epoxies), or joined with similar difficult-to-disengage means, are not "attachable" or "detachable" as those terms are used in this disclosure, and may be referred to as "permanently" joined to connote that separation of such structures or components is not intended. In this disclosure, the term "driving means" with respect to screws or other threaded fasteners means any of the various shaped cavities and protrusions on a screw head that allow torque to be applied to a screw, including but not limited to recesses having a slot, cross, Phillips, frearson, French recess, JIS B 1012, Mortorq, Pozidriv, Supadriv, torq-set, or combination phillips/slotted shape, and also recesses or protrusions having a square, pentagonal, hex, 12-point, tri-angle, Robertson, hex socket, security hex, double-square, triple-square, XZN, 12-spline flange, double hex, torx, T & TX, security torx, TR, torx plus, Polydrive, torx ttap, line head, line head, tri-point, tri-groove, tri-wing, clutch A, clutch G, one-way, Bristol, Quadrex, pentalobular, or spanner shape. Also, in this disclosure the terms "head" and "screw head" mean the end of a threaded fastener comprising the driving means, which may have various shapes, including but not limited to pan head, button or dome head, round head, mushroom or truss head, countersunk or flat head, oval or raised head, bugle head, cheese head, fillister head, socket head, and which may be configured with or without flanges or shoulders or both.

Figure 11:
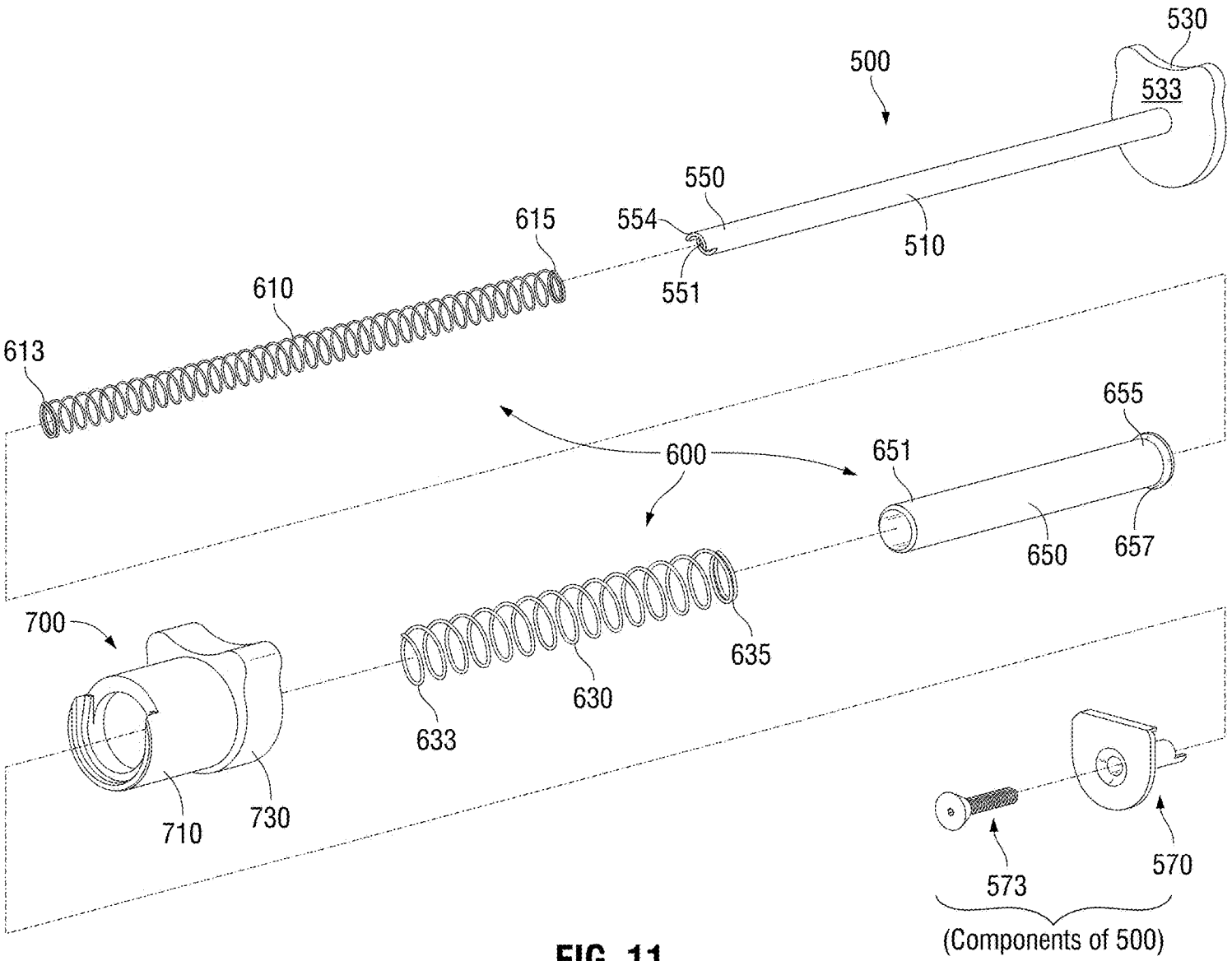
FIG. 11 is an exploded perspective view of a recoil system embodiment.

FIG. 1 and FIG. 11 each depict an exploded view of a recoil system embodiment. For each of these preferred embodiments, the recoil system comprises guide rod assembly 100/500, damper assembly 200/600, and slide plug 300/700.

In the embodiments of FIG. 1 and FIG. 11, guide rod assembly 100/500 comprises guide rod 110/510, guide rod head 130/530, and plug retainer 170/570. Guide rod 110/510 in the depicted embodiments is generally cylindrical. For these embodiments, guide rod head 130/530 is disposed adjacent to the reward end of guide rod 110/510. Preferably, guide rod head 130/530 and guide rod 110/510 are made integrally, but in other embodiments may be made separately and permanently or detachably joined. Also for these embodiments, plug retainer 170/570 is disposed adjacent to the forward end of guide rod 110/510. Preferably, plug retainer 170/570 and guide rod 110/510 are separate attachable and detachable components, but in other embodiments may be integral or permanently joined. Because slide plug 300/700 and damper assembly 200/600 (or a single recoil spring) are captured between guide rod head 130/530 and plug retainer 170/570, if the ability to disassemble the damper system is desired, at least one of guide rod head 130/530 and plug retainer 170/570 should be detachable from guide rod 110/510.

In the embodiments of FIG. 1 and FIG. 11, guide rod head 130/530 comprises guide rod head spring face 133/533. A guide rod head spring face preferably is generally planar, but other configurations capable of supporting the end of a spring may be used. In the depicted embodiments, guide rod head 130/530 has a "shield" shape with edge scallops configured and oriented to accommodate structures in a pistol, for example the bottom of a barrel or the edges of a slide, but other configurations may be used.

In the embodiments of FIG. 1 and FIG. 11, plug retainer 170/570 is disposed at guide rod forward end 150/550. In these embodiments, plug retainer 170/570 is attachable to and detachable from guide rod 110/510 by the interfitting of complementary plug retainer attachment means 173/573 and guide rod forward end attachment means 151/551. Plug retainer 170/570 of these embodiments comprises plug retainer catch means 175/575 and plug retainer seating bevel 177/577.

In the embodiments of FIG. 1 and FIG. 11, damper assembly 200/600 comprises inner spring 210/610, outer spring 230/630, and damper tube 250/650. In the assembled configuration of these embodiments, inner spring 210/610 extends longitudinally from inner spring forward end 213/613 to inner spring rearward end 215/615, and outer spring 230/630 extends longitudinally from outer spring forward end 233/633 to outer spring rearward end 235/635. In the depicted embodiments, each of inner spring forward end 213/613 and inner spring rearward end 215/615 are closed, outer spring forward end 233 and outer spring rearward end 235/635 are closed, and outer spring forward end 633 is open, but in other embodiments the inner and outer springs may have closed ends (either square or ground), open ends, or pigtail ends in any combinations. In the embodiments of FIG. 1 and FIG. 11, damper tube 250/650 comprises damper tube forward end 251/651, damper tube rearward end 255/655, damper tube inner spring seat 253/653, and damper tube outer spring seat 257/657. In the assembled configuration of these embodiments, inner spring forward end 213/613 is supported by damper tube inner spring seat 253/653, inner spring rearward end 215/615 is supported by guide rod head spring face 133/533, outer spring forward end 233/633 is supported by slide plug spring seat 360/760, and outer spring rearward end 235/635 is supported by damper tube outer spring seat 257/657.

Figure 2:
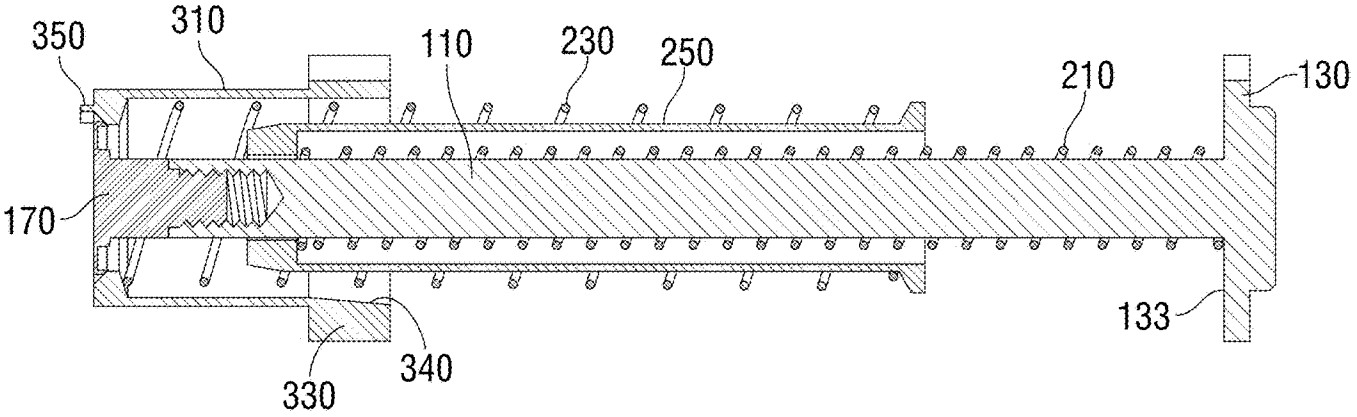
FIG. 2 is a longitudinal section view of the system depicted in FIG. 1.
Figure 3:
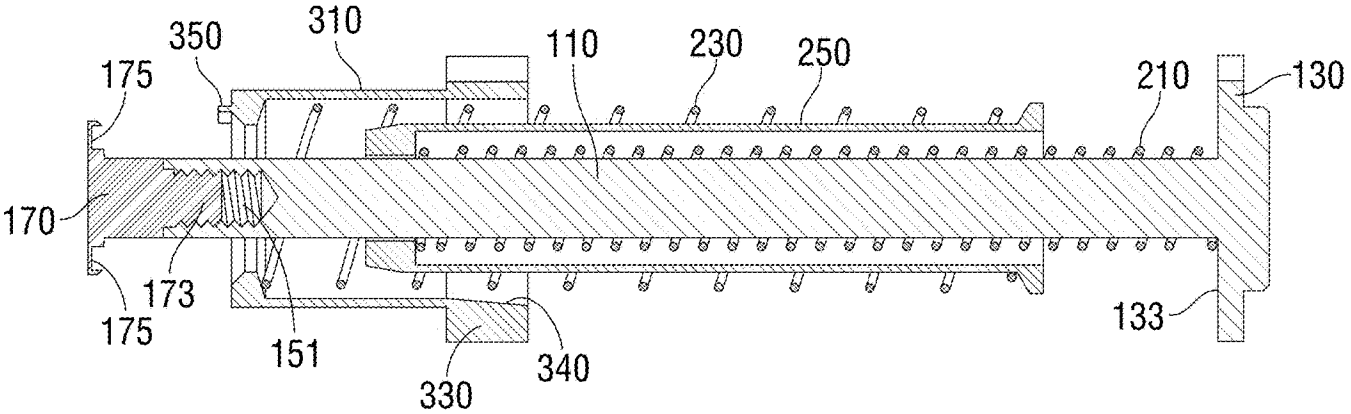
FIG. 3 is a longitudinal section view of the system depicted in FIG. 1.
Figure 4:
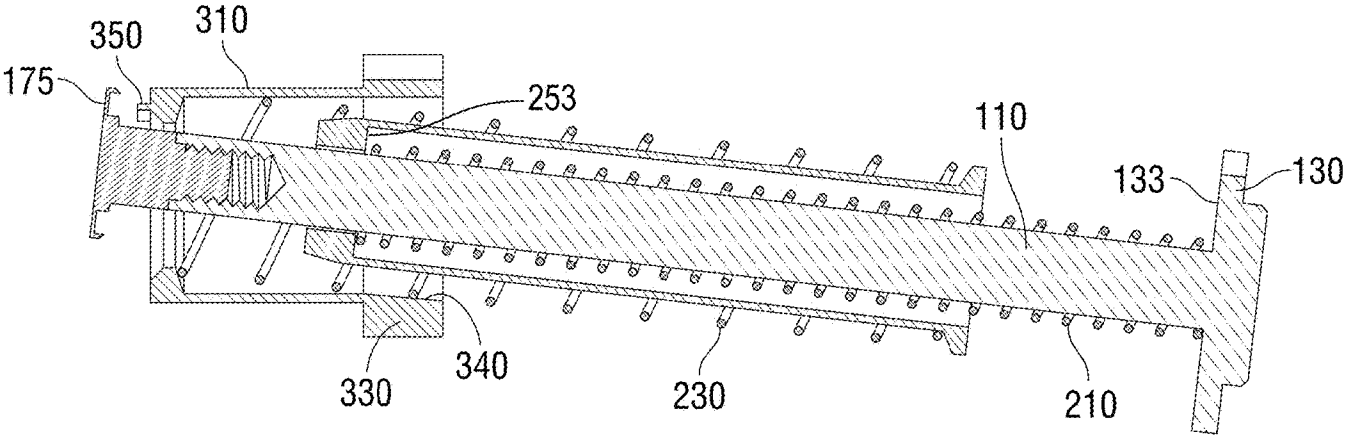
FIG. 4 is a longitudinal section view of the system depicted in FIG. 1.
Figure 5:
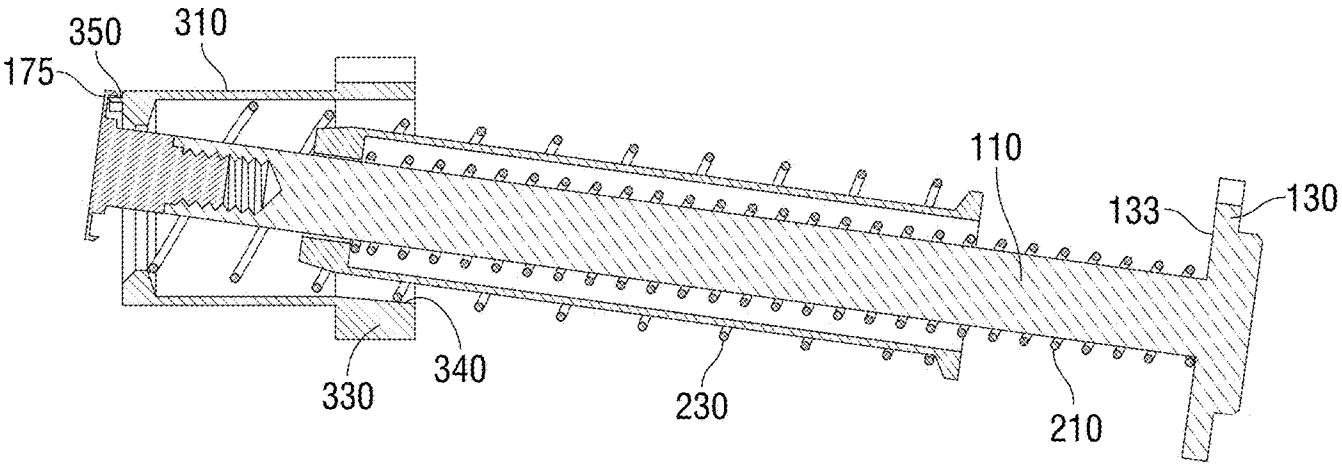
FIG. 5 is a longitudinal section view of the system depicted in FIG. 1.
Figure 7:
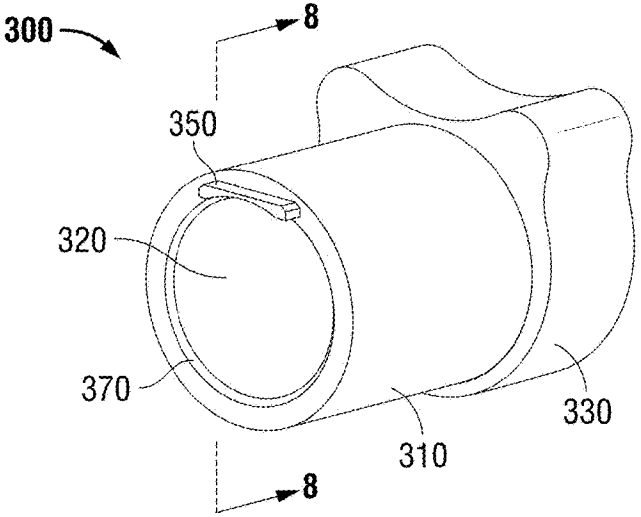
FIG. 7 is a perspective view of the slide plug depicted in FIG. 1.
Figure 6:
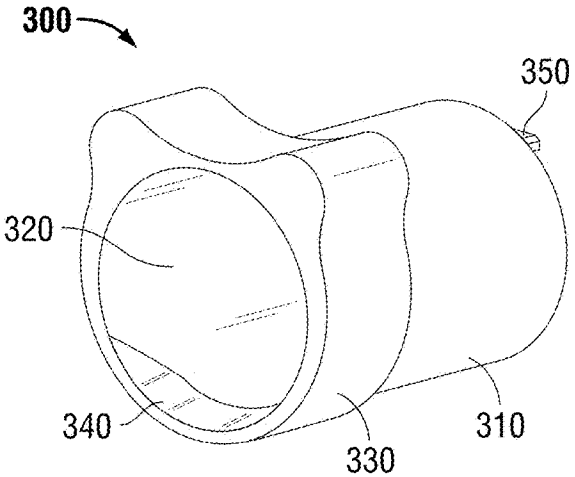
FIG. 6 is a perspective view of the slide plug depicted in FIG. 1.
Figure 14:
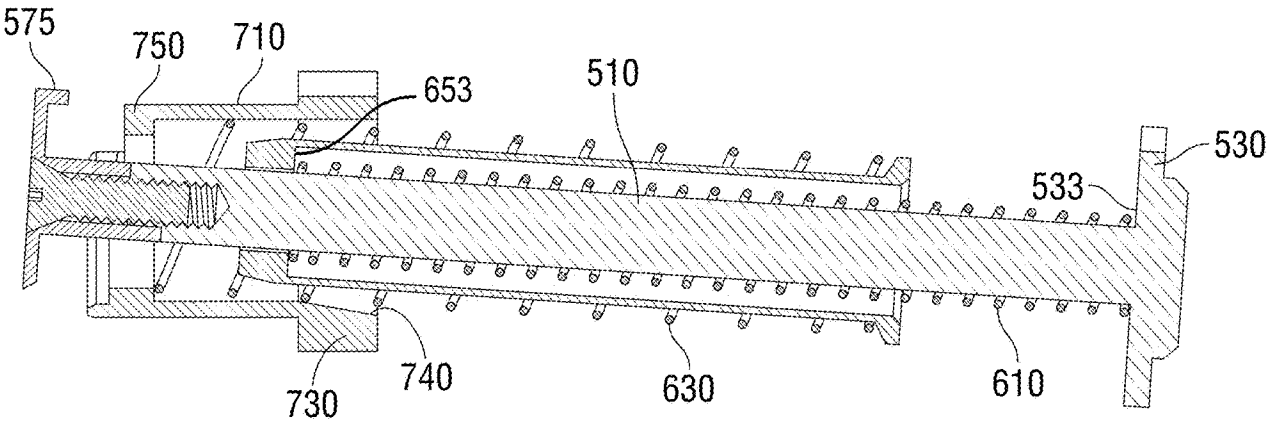
FIG. 14 is a longitudinal section view of the system depicted in FIG. 11.
Figure 15:
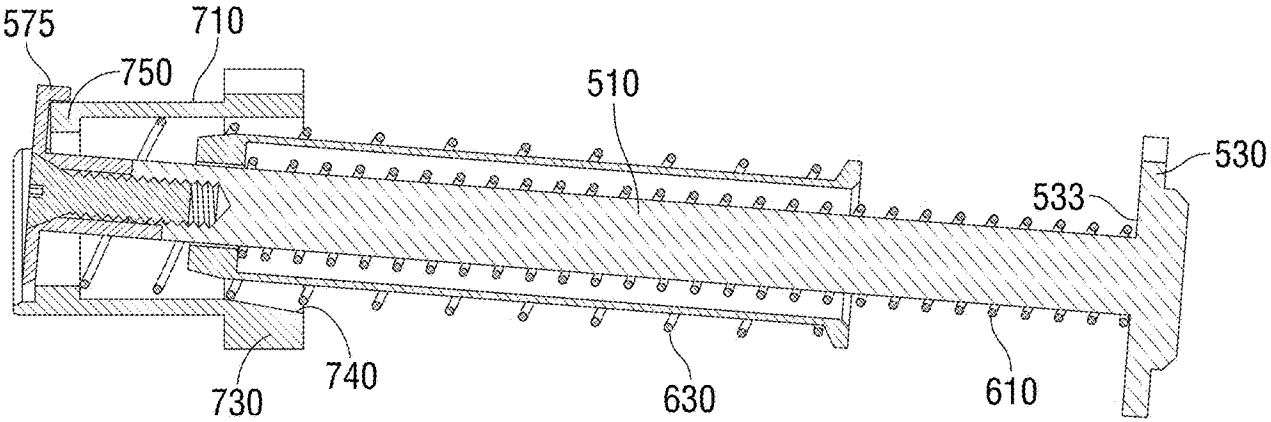
FIG. 15 is a longitudinal section view of the system depicted in FIG. 11.
Figure 17:
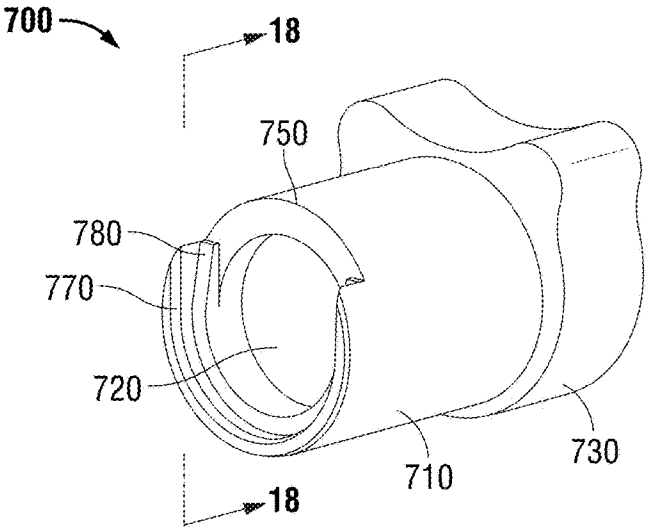
FIG. 17 is a perspective view of the slide plug depicted in FIG. 11.
Figure 16:
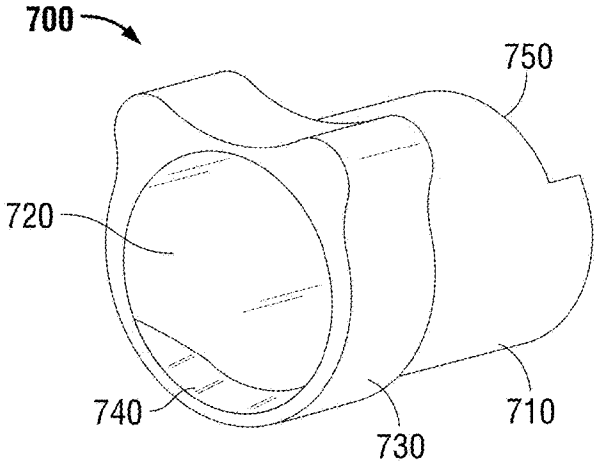
FIG. 16 is a perspective view of the slide plug depicted in FIG. 11.
Figure 18:
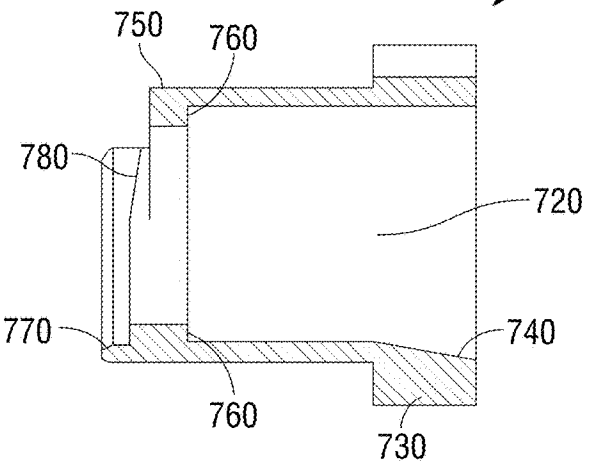
FIG. 18 is a section view of the slide plug depicted in FIG. 11 taken upon section plane 18-18 indicated on FIG. 17.

In the embodiments of FIG. 1 and FIG. 11, slide plug 300/700 comprises slide plug body 310/710 and slide plug head 330/730. In these embodiments, slide plug body boring 320/720 extends longitudinally through slide plug body 310/710 and slide plug head 330/730. Preferably, slide plug articulation bevel 340/740 is disposed in the lower portion of the reward opening of slide plug body boring 320/720, which enhances the ability of assembled guide rod assembly 100/500 to cant or tilt downward with respect to slide plug 300/700 as depicted in FIGS. 4 and 14, which in turn enhances the interfitting of plug retainer catch means 175/575 with slide plug catch means 350/750 as depicted in FIG. 5 and FIG. 15. In the depicted embodiments, slide plug spring seat 360/760 is disposed at the forward end of slide plug body boring 320/720 and supports outer spring forward end 233/633 when the recoil system is assembled and operating. The depicted embodiments also comprise slide plug seating bevel 370/770, which preferably is configured with portions complementarily to portions of plug retainer seating bevel 177/577 and arranged to interfit with portions of plug retainer seating bevel 177/577 when the recoil system is in the assembled position depicted in FIG. 2 and FIG. 12.

Figure 8:
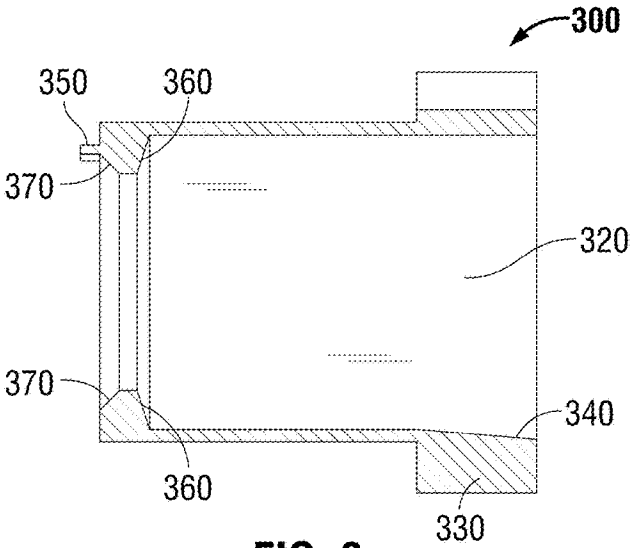
FIG. 8 is a section view of the slide plug depicted in FIG. 1 taken upon section plane 8-8 indicated on FIG. 7.
Figure 9:
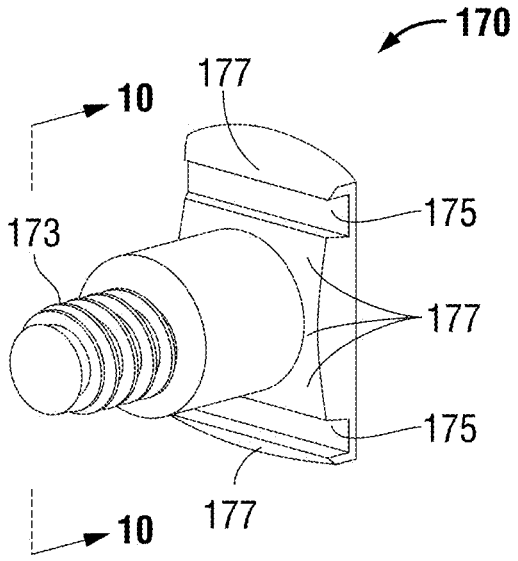
FIG. 9 is a perspective view of the plug retainer depicted in FIG. 1.
Figure 10:
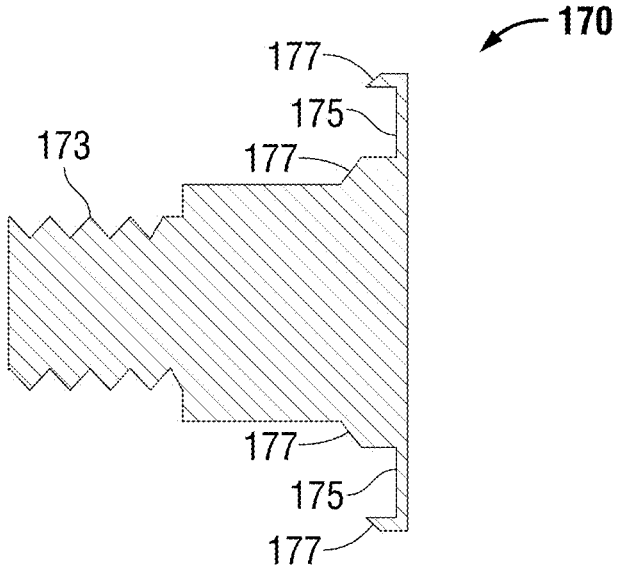
FIG. 10 is a section view of the plug retainer depicted in FIG. 1 taken upon section plane 10-10 indicated on FIG. 9.

In the embodiment depicted in FIG. 1-FIG. 5, FIG. 6-FIG. 8 depict further structures and arrangements of slide plug 300, and FIG. 9 and FIG. 10 depict further structures and arrangements of plug retainer 170. In this embodiment, plug retainer catch means 175 is deployed at least partially as a tab or slot, and slide plug catch means 350 is deployed as a shelf-like protrusion from the forward face of slide plug body 310, and is sized and configured to interfit with plug retainer catch means 175 when this exemplary recoil system embodiment is in the position depicted in FIG. 5. As shown in FIG. 8, slide plug spring seat 360 is beveled, which may enhance the centering of outer spring forward end 233 around guide rod 110. In this embodiment, plug retainer attachment means 173 is configured as a threaded cylindrical section of the body of plug retainer 170, with threads compatible with the threads of guide rod forward end attachment means 151, which is deployed as a threaded boring. The compatible threads may be cut so that plug retainer 170 is indexed in vertical alignment with guide rod head 130 when plug retainer 170 is firmly affixed to guide rod forward end 150. Alternatively, other indexing means may be used, such as knurling on the abutting ends of plug retainer 170 and guide rod forward end 150, or such as a crush washer or lock washer or thrust washer inserted around plug retainer attachment means 173 and disposed between the head of plug retainer 170 and guide rod forward end 150 when those components are tightened. Preferably, plug retainer 170 comprises plug retainer seating bevel 177, which in this embodiment is disposed along the outer edges of the inner forward face of plug retainer 170 and along the central portion of that face. The cooperation and compatibility of plug retainer seating bevel 177 with slide plug seating bevel 370 encourages the centralized relocation and interfitting of plug retainer 170 with slide plug 300 when guide rod assembly 100 translates rearward upon the slide of the firearm returning into battery.

Figure 19:
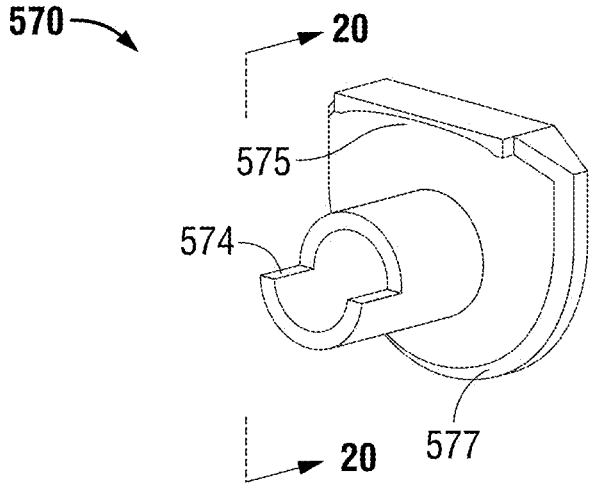
FIG. 19 is a perspective view of the plug retainer depicted in FIG. 11.
Figure 20:
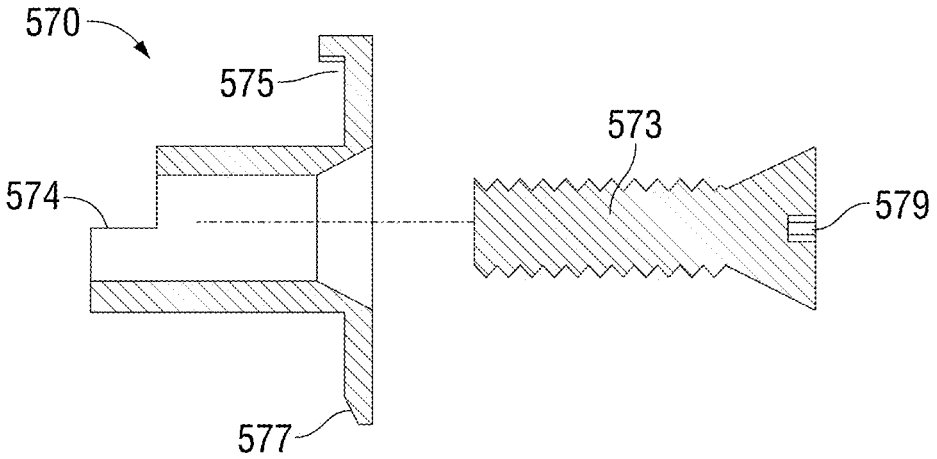
FIG. 20 is a section view of the plug retainer depicted in FIG. 11 taken upon section plane 20-20 indicated on FIG. 19.

In the embodiment depicted in FIG. 10-FIG. 15, FIG. 16-FIG. 18 depict further structures and arrangements of slide plug 700, and FIG. 19 and FIG. 20 depict further structures and arrangements of plug retainer 570. In this embodiment, slide plug catch means 750 is deployed as a portion of the forward edge and upper outer face of slide plug body 710, with plug retainer catch means 575 configured as a shelf-like protrusion or tab on the forward inner face of plug retainer 570 and the space below that protrusion. When this embodiment is arranged as depicted in FIG. 15 so that this recoil system embodiment is held in a partially compressed configuration, slide plug catch means 750 is disposed in the space below the shelf-like protrusion portion of plug retainer catch means 575 with lateral edge portions of the forward inner face of plug retainer 570 in contact with slide plug support shelfs 780. In this embodiment, slide plug spring seat 760 is not beveled, but other embodiments may deploy a beveled slide plug spring seat. In this embodiment, plug retainer attachment means 573 is configured as a threaded fastener having a head with plug retainer attachment driving means 579, the threads being compatible with the threads of guide rod forward end attachment means 551, which is deployed as a threaded boring. In this embodiment, plug retainer 570 is indexed in vertical alignment with guide rod head 530 when plug retainer 570 is firmly affixed to guide rod forward end 550 by complementary interfitting of plug retainer index means 574 with guide rod forward end index means 554 deployed as interfitting notches. Alternatively, other indexing means may be used, for example knurling, washers, or releasable adhesives. Preferably, plug retainer 570 comprises plug retainer seating bevel 577, which in this embodiment is disposed along portions of the outer edge of the inner forward face of plug retainer 570. The cooperation and compatibility of plug retainer seating bevel 577 with slide plug seating bevel 770 encourages the centralized relocation and interfitting of plug retainer 570 with slide plug 700 when guide rod assembly 500 translates rearward upon the slide of the firearm returning into battery.

Figure 21:
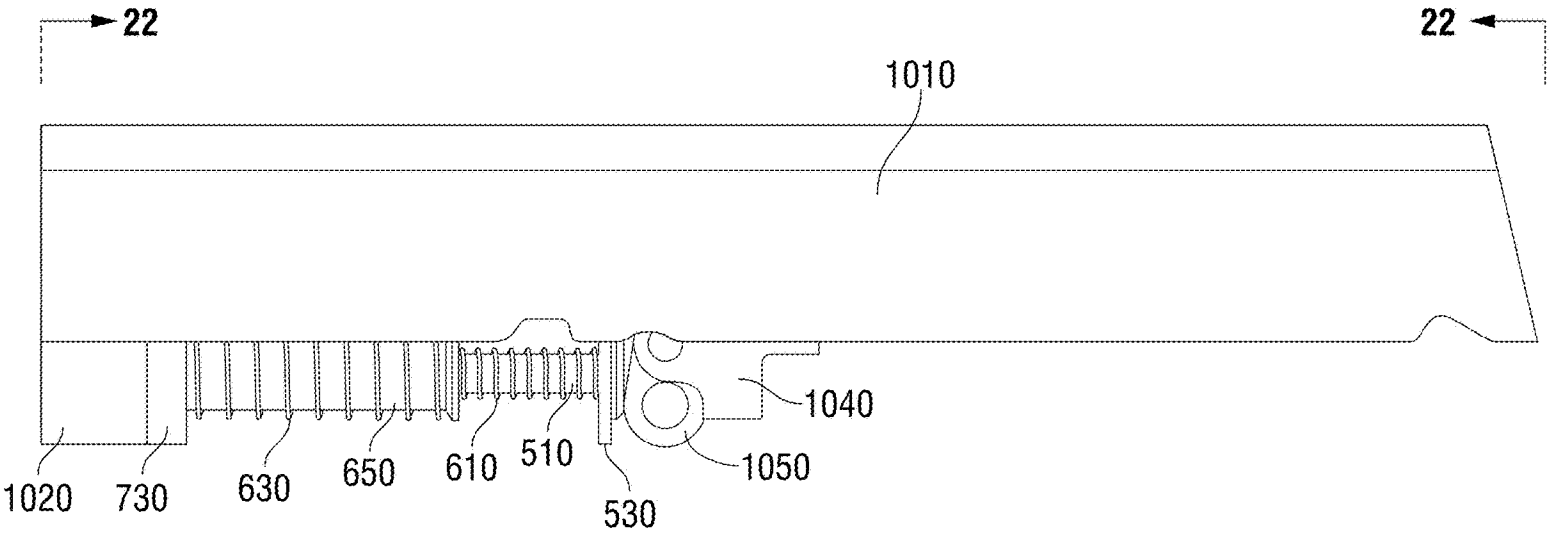
FIG. 21 is a side view of the system depicted in FIG. 11 installed with an exemplary slide and barrel.
Figure 22:
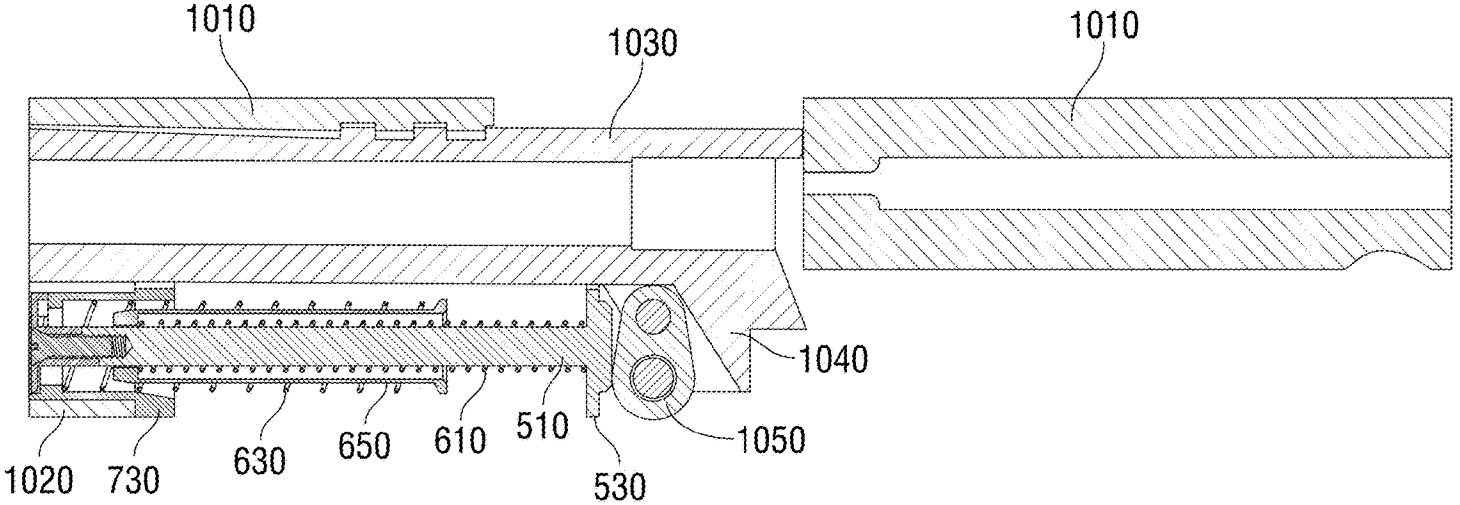
FIG. 22 is a section view of the components depicted in FIG. 21 taken upon section plane 22-22 indicated on FIG. 21.

FIG. 21 and FIG. 22 depict the recoil system embodiment of FIG. 11-FIG. 20 deployed in an exemplary firearm configuration. The depicted embodiments of this disclosure are particularly adaptable for use in single-stack or double-stack pistols patterned generally on the M1911 pistol design of John Browning for Colt Manufacturing Company, but the depicted embodiments and other embodiments deploying a slide plug catch means and a plug retainer catch means may be adapted and arranged for other firearm designs having a reciprocating slide and a recoil system. In the example of FIG. 21 and FIG. 22, the firearm comprises exemplary slide 1010, which is formed with an open bottom except for exemplary slide spring tunnel 1020. FIG. 21 and FIG. 22 also depict exemplary barrel 1030 comprising exemplary barrel lower lug 1040 and exemplary barrel link 1050. Except for the exemplary embodiment of a recoil system depicted, FIG. 21 and FIG. 22 do not show other components of the firearm, such as the frame, grip, fire control components, sights, etc., which are well known to those of skill in the art.

As depicted in the exemplary environment of FIG. 21 and FIG. 22, the recoil system embodiment of FIG. 11-FIG. 20 comprises slide plug head 730, outer spring 630, damper tube 650, inner spring 610, guide rod 510, and guide rod head 530, and the other components depicted in FIG. 11-FIG. 20 and described elsewhere in this disclosure. In this example of an assembled configuration, guide rod head 530 is adjacent to barrel lower lug 1040 and barrel link 1050. Also in this preferred embodiment, slide plug body 710 interfits in a complementary boring in slide spring tunnel 1020, with slide plug head 730 outside and abutting the rearward end of slide spring tunnel 1020. In other embodiments, however, a slide plug head may be deployed entirely or partially within the slide spring tunnel.

Figure 12:
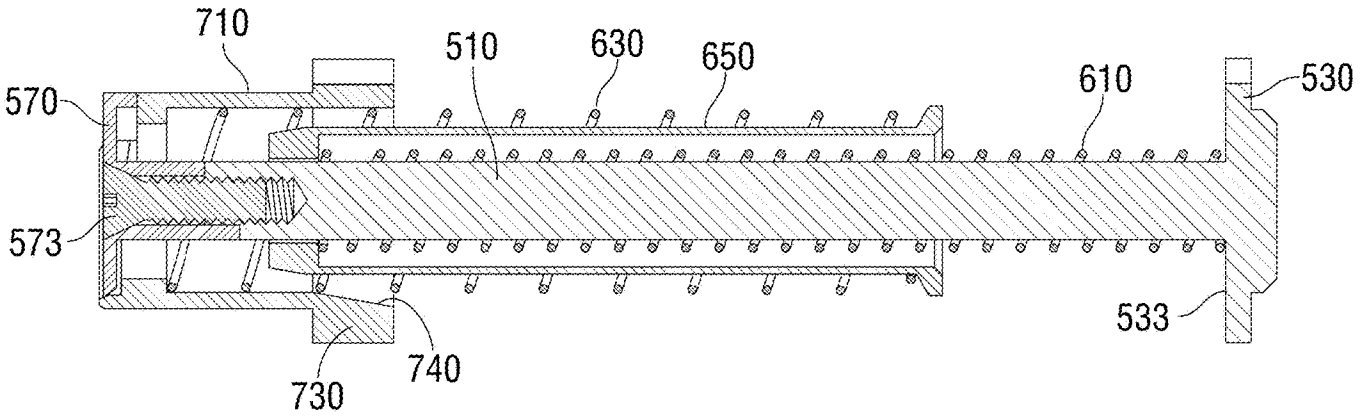
FIG. 12 is a longitudinal section view of the system depicted in FIG. 11.
Figure 13:
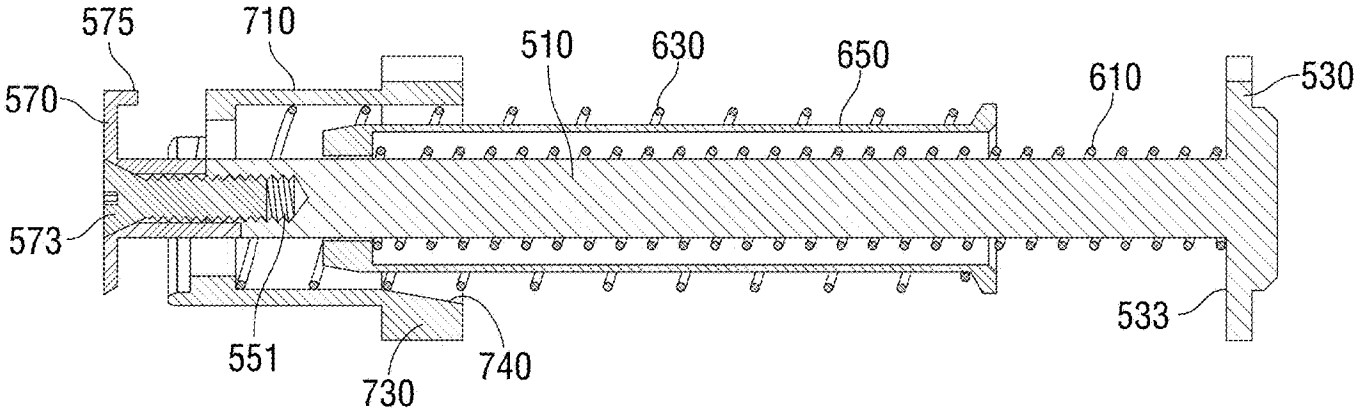
FIG. 13 is a longitudinal section view of the system depicted in FIG. 11.

A recoil system comprising a slide plug catch means and a plug retainer catch means, for example such as depicted in FIG. 1-FIG. 10 and FIG. 11-FIG. 20, enables novel methods of removing the recoil system from an assembled configuration with a slide and barrel. For example, FIG. 13-FIG. 15 depict an exemplary method of removing the recoil system from the exemplary deployment depicted in FIG. 21 and FIG. 22. For example, with the slide, barrel, and recoil system assembled and at rest as shown in FIG. 21, FIG. 22, and FIG. 12, forward pressure on guide rod head 530 compresses inner spring 610 and outer spring 630 and translates guide rod assembly 500 forward. With plug retainer 570 translated forward and no longer captured in the forward end of slide plug 700, in this example guide rod head 530 can be moved downward or tilted as depicted in FIG. 14, rotating guide rod assembly 500 with respect to slide plug 700. As further discussed elsewhere in this disclosure, the preferred deployment of slide plug articulation bevel 740 enhances the range of rotation available, but other embodiments may omit the bevel feature. With guide rod assembly 500 rotated with respect to slide plug 700 and with plug retainer 570 translated forward and no longer captured in the forward end of slide plug 700, pressure on guide rod head 530 may be partially released, causing inner spring 610 and outer spring 630 to resile and translate guide rod assembly 500 rearward until the position depicted in FIG. 15 is reached, at which point pressure may be fully removed from guide rod head 530 causing all spring forces to be borne by the interfitting of slide plug catch means 750 and plug retainer catch means 575. In this example of a tilt-lock method, the recoil system is now in a partially compressed configuration and may be removed from the installation depicted in FIG. 21 and FIG. 22. A similar tilt-lock method may be used for the recoil system depicted in FIG. 1-FIG. 10.

For other embodiments of a recoil system comprising a slide plug catch means and a plug retainer catch means, novel method of removing the recoil system comprise the step of interfitting the slide plug catch means with the plug retainer catch means to hold the recoil system in a partially compressed configuration.

Although each of the above-described preferred embodiments deploy damper assembly 200/600, other embodiments may omit the use of a damper assembly. For example, some embodiments may deploy a single recoil spring, with its forward end seating on a surface of a slide plug and its reward end seating on a surface of a guide rod head. Operating and capturing structures and methods in such embodiments preferably may be configured consistently with those depicted in FIG. 1-FIG. 10 or FIG. 11-FIG. 22, although other structures and methods and combinations thereof may be deployed.

In some alternate embodiments, a guide rod plug retainer may be fixed to a guide rod forward end. In such embodiments, disassembly of the recoil system may be provided by deploying detachable means for securing the guide rod head to the rearward end of the guide rod. For example, the rearward end of the guide rod may be provided with external threads engageable with internal threads of a boring in the guide rod head. Alternatively, the reward end of the guide rod may be provided with a boring having internal threads engageable with threaded fastener configure to pass through a boring in the guide rod head and configured with a head sized to retain the guide rod head to the guide rod when the fastener is tightened in the guide rod boring. In some of these alternate embodiments, the guide rod, the guide rod head, or both may be configured with index means that maintain a specific orientation of the guide rod with the guide rod head, for example, interfitting notches such as guide rod forward end index means 554 and plug retainer index means 574. In yet other embodiments in which the ability to disassemble the recoil system is not desired, the guide rod, guide rod head, and plug retainer may be permanently joined.

After appreciating this disclosure, those of skill in the art will recognize that the steps of the various methods, processes, and other techniques disclosed herein need not be performed in any particular order, unless otherwise expressly stated or logically necessary to satisfy expressly stated conditions or circumstances. In addition, after appreciating this disclosure, those skilled in the art will recognize that other embodiments may have a variety of different forms of devices and systems, and that various changes, substitutions, and alterations may be made without departing from the spirit and scope of this disclosure. The described embodiments are illustrative only and are not restrictive, and the scope of this disclosure is defined solely by the following claims and any further claims in this application or any application claiming priority to this application.

The invention claimed is:

1. A recoil system for a firearm comprising:

a slide plug comprising a first catch means and configured to interfit in a complementary boring in a slide spring tunnel of the firearm; and a guide rod having a forward end, the guide rod comprising a plug retainer disposed at the forward end, and the plug retainer comprising a second catch means; with the first catch means and the second catch means configured compatibly to interfit; and with the recoil system having a partially compressed configuration in which the guide rod is tilted with respect to the slide plug, and the first catch means and the second catch means interfit.

2. The recoil system of claim 1 in which the slide plug comprises an articulation bevel disposed along a rearward end of the slide plug.

3. The recoil system of claim 2 in which the slide plug comprises a support shelf and the plug retainer comprises an inner face, with the support shelf in contact with the inner face when the recoil system is in the partially compressed configuration.

4. The recoil system of claim 2 in which the first catch means comprises a protrusion.

5. The recoil system of claim 2 in which the second catch means comprises a protrusion.

6. The recoil system of claim 2 in which the first catch means comprises a portion of a forward edge of the slide plug and an upper outer face of the slide plug.

7. The recoil system of claim 2 in which the second catch means comprises a tab.

8. The recoil system of claim 2 in which the second catch means comprises a slot.

9. The recoil system of claim 2 in which the plug retainer is attachable to and detachable from the guide rod.

10. The recoil system of claim 9 further comprising attachment means for attaching the plug retainer and the guide rod.

11. The recoil system of claim 10 in which the attachment means comprise a fastener.

12. The recoil system of claim 11 further comprising index means for holding the plug retainer in a vertical orientation with respect to the slide plug.

13. The recoil system of claim 12 in which the index means comprise notches having a complementary interfitting configuration.

* * * * *